United States Patent [19]

Wax

[11] 4,081,711

[45] Mar. 28, 1978

[54] SPARK PLUG

[76] Inventor: Bernard Wax, 28 Highland Ave., Succasunna, N.J. 07876

[21] Appl. No.: 746,175

[22] Filed: Nov. 30, 1976

[51] Int. Cl.[2] ..... H01T 13/20

[52] U.S. Cl. ..... 313/143; 313/142

[58] Field of Search ..... 313/143, 142

[56] References Cited

U.S. PATENT DOCUMENTS 3,965,384 6/1976 Yamazaki ..... 313/142

*Primary Examiner*—Rudolph V. Rolinec
*Assistant Examiner*—Darwin R. Hostetter
*Attorney, Agent, or Firm*—Rudolph J. Jurick

[57] ABSTRACT

A spark plug for providing an increase in the horsepower output of an internal combustion engine, at the same fuel consumption rate as with conventional plugs, which spark plug has a ground electrode spaced from a center electrode and an arcuate ring member spaced from and spanning the ground electrode.

12 Claims, 13 Drawing Figures

SPARK PLUG

BACKGROUND OF THE INVENTION

Spark plugs of various constructions have been proposed for improving the operating efficiency of an internal combustion engine. Certain prior spark plugs have electrode arrangements for producing a plurality of sparks during each firing cycle of the plug as, for example, the construction shown in J. A. Stahr U.S. Pat. No. 2,208,059, issued July 16, 1940. Other spark plugs have electrodes constructed and arranged to be self-cleaning, as shown in T. T. Bathurst U.S. Pat. No. 1,384,818, issued July 19, 1921. My U.S. Pat. No. 3,872,338, issued Mar. 18, 1975 discloses a spark plug in which both of the electrodes are encased in a ceramic material to eliminate electric and chemical corosion, thereby prolonging the operating life of the plug. Still other prior spark plugs are provided with auxiliary members for modifying the propagation of the combustion flame, as shown in K. Yamazaki U.S. Pat. No. 3,965,384, issued June 22, 1976. While the prior spark plugs provide varying degrees of improved operating results, they do not result in a significant increase in the horsepower output of the engine under given engine operating conditions. A spark plug made in accordance with this invention is of simple construction, has a long operating life, and results in an unexpectedly large increase in engine horsepower output at the same fuel consumption rate as when the engine is equipped with conventional spark plugs.

SUMMARY OF THE INVENTION

A spark plug having an end of a center electrode spaced from a ground electrode to form a spark gap, said ground electrode lying in the median plane of the spark plug. Secured to the metal shell of the spark plug is a semi-circular ring member which extends over the ground electrode and lies in a plane normal to that which contains the ground electrode. In certain specific embodiments of the invention, the end of the center electrode is covered by a ceramic and the ring member has a non-uniform cross-sectional configuration from end to end thereof.

An object of this invention is the provision of a spark plug of improved construction which provides an increase in the fuel combustion efficiency of an internal combustion engine.

An object of this invention is the provision of a spark plug provided with means for dividing and improving propagation of a combustion flame within the cylinder of an internal combustion engine.

An object of this invention is the provision of an improved spark plug that includes a combustion divider which divides a propagating wavefront of a combustion flame into two sections as it moves from the point of ignition.

An object of this invention is the provision of a spark plug having a center electrode constructed and arranged to provide an increased operating life.

The above-stated and other objects and advantages of the invention will become apparent from the following description when taken with the accompanying drawings. It will be understood, however, that the drawings are for purposes of illustration and are not to be construed as defining the scope or limits of the invention, reference being had for the latter purpose to the claims appended hereto.

BRIEF DESCRIPTION OF THE DRAWINGS

In the drawings wherein like reference characters denote like parts in the several views.

DESCRIPTION OF PREFERRED EMBODIMENTS

Figure 1:
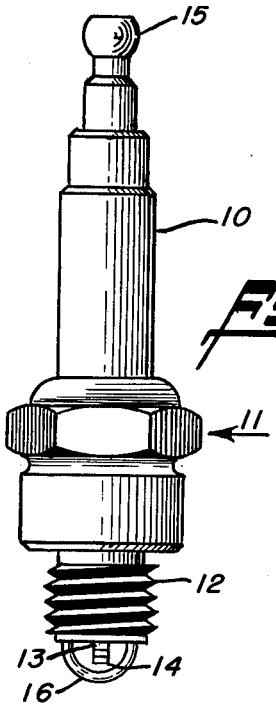
FIG. 1 is a side elevational view of a spark plug made in accordance with one embodiment of this invention.
Figure 2:
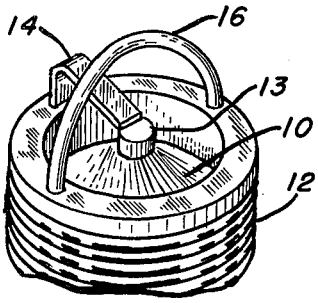
FIG. 2 is a fragmentary isometric view of the lower end portion of the spark plug.

Reference now is made to FIGS. 1 and 2 wherein there is shown a spark plug comprising a ceramic core 10 carried by a metal shell 11 having an externally threaded portion 12. The lower end of a center electrode 13 is spaced from a ground electrode 14 and the upper end of the center electrode is secured to a metal terminal member 15 which serves as a means for connecting the spark plug to the ignition system of an internal combustion engine. The ground electrode lies in a median plane of the spark plug. In accordance with this invention, an arcuate ring member 16 has its ends secured to the threaded shell portion 12 and its central portion spaced from the ground electrode 14.

An internal combustion engine provided with spark plugs constructed as hereinabove described, developes an increased horsepower output for a given fuel consumption rate, as compared to the output when the engine is equipped with conventional spark plugs. By actual tests, engines equipped with the described spark plugs delivered 28–55% more horsepower, depending upon the particular engine tested. These results indicate that the fuel combustion is more complete and occurs over a shorter time period. Although the exact theory of operation is not understood, it is believed that the ring member 16 functions as a combustion divider which divides the flamefront as it propagates from the spark gap into the engine cylinder. Once the combustion flame is severed by the divider, the resulting two wavefronts, because of the very nature of wave propagation in a charged atmosphere, oppose each other and do not join together again. The surface area of the two flamefronts is greater than that of a single wavefront and consequently, the burn rate of the fuel is speeded up.

The combustion divider 16 may be made of a metal or a metal alloy capable of withstanding the high temperatures encountered under engine operating conditions. However, as the divider does not conduct electricity it can be made of any suitable material such as, for example, a ceramic. In any case, I have found that the best results are obtained when the spark plug is equipped with a single combustion divider which has a semi-circular shape, has its ends positioned on a diameter of the spark plug, and lies in a plane which is normal to the median plane containing the ground electrode.

Figure 3:
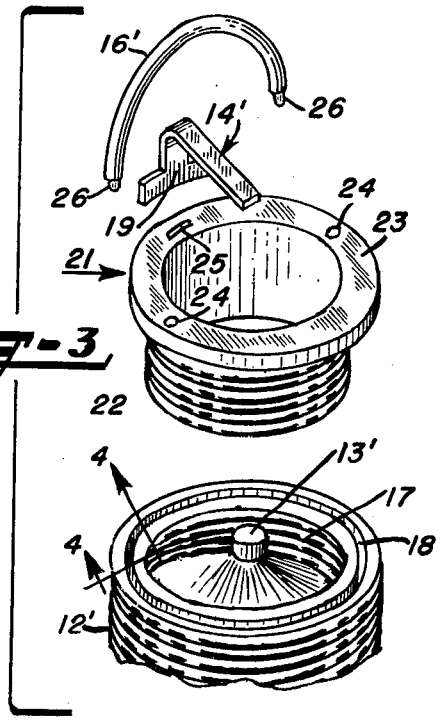
FIG. 3 is an exploded, fragmentary, isometric view showing certain parts of a spark plug made in accordance with another embodiment of the invention.
Figure 5:
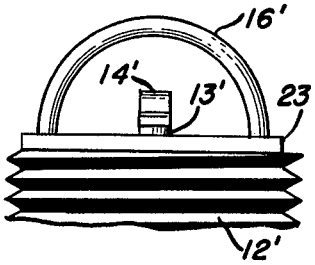
FIG. 5 is a fragmentary side elevational view showing the parts of FIG. 3 assembled together.
Figure 4:
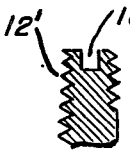
FIG. 4 is a cross-sectional view taken along the line 4—4 of FIG. 3.

A modification of the spark plug construction is shown in FIGS. 3–5. Here the center electrode 13′ normally projects somewhat beyond the end surface of the threaded shell portion 12′, which shell portion also is provided with an internal thread 17. A circular groove 18 is formed in the end surface of the shell portion 12′, which groove is adapted to receive the generally T-shaped end portion 19 of the ground electrode 14′. An insert member 21 has an externally threaded shank terminating in a flange 23, said flange being provided with two holes 24 and an arcuate slot 25. The ground electrode 14′ initially has a mono-planar leg portion and the spark plug is assembled by first passing the leg portion of the ground electrode upwardly through the flange slot 25, after which the shank of the insert member 21 is threaded into the shell portion 12′ with the ground electrode end portion 19 positioned in the circular groove 18. When the insert member is threaded tightly into place, positive electric contact is established between the ground electrode and the threaded shell portion 12′, without requiring a welding operation. The free end of the ground electrode then is bent toward the center electrode 13′ to provide a spark gap of desired length. The combustion divider 16′ has reduced diameter end portions which fit into the flange holes 24. These holes serve to properly locate the combustion divider which may be welded in place. Alternatively the divider ends may be force-fitted into the holes 24.

Figure 6:
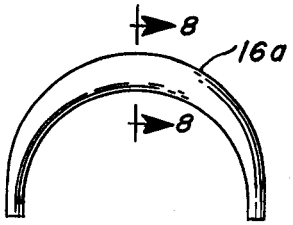
FIG. 6 is an isometric view of a combustion divider having a different configuration.
Figure 7:
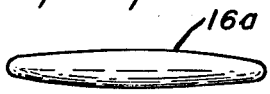
FIG. 7 is a top plan view thereof.
Figure 8:
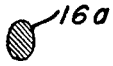
FIG. 8 is a cross-sectional view taken along the line 8—8 of FIG. 6.
Figure 9:
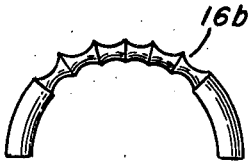
FIG. 9 is an isometric view of a combustion divider having still another configuration.
Figure 10:
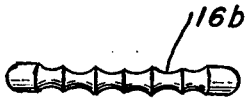
FIG. 10 is a corresponding top plan view thereof.

Improved engine operating results are obtained when the combustion divider has a non-uniform diameter from end to end thereof. Specifically, the combustion divider 16*a*, shown in FIGS. 6–8, has an elliptical cross-sectional configuration which varies from a maximum cross-sectional area at the center to a minimum cross-sectional area at the ends. The combustion divider 16*b*, shown in FIGS. 9 and 10 has a fluted central portion. These aerodynamic designs of the combustion divider result in speeding up the propagation of the flamefront around the divider, which advantageously increases the burn rate of the fuel.

Figure 11:
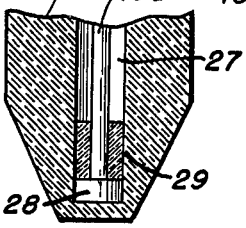
FIGS. 11–13 are fragmentary, cross-sectional views showing other forms of the center electrode.
Figure 12:
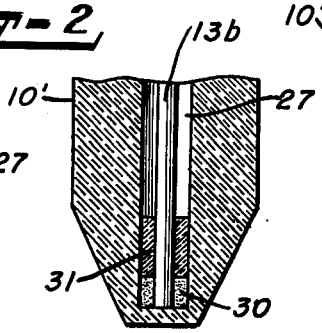
Figure 13:
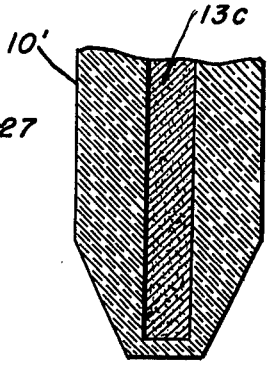

The operating life of the spark plug is increased significantly by encasing the tip of the center electrode in the core. As shown in FIG. 11, a bore 27 is formed in the core 10′. The center electrode 13*a* has an integral head 28 and is held in place by means of ceramic paste 29. Preferably, there is a small space between the head 28 and the wall of the bore to allow for expansion and contraction of the metal without fracturing the core. In the FIG. 12 embodiment, the center electrode 13*b* has a uniform diameter, extends into the graphite powder 30 and is secured in place by ceramic paste 31. In the FIG. 13 embodiment, the center electrode 13*c* comprises a metallic paste which fills the bore in the core 10′.

Having now described the invention what I desire to protect by letters patent is set forth in the following claims.

I claim:

1. A spark plug comprising,
   a. a core of insulating material carried by a metal shell,
   b. a center electrode carried by the core,
   c. a ground electrode connected to the shell and spaced from an end of the center electrode to form a spark gap, and
   d. solely a single arcuate ring member having its ends lying substantially on a diameter of the spark plug and secured to said shell, said ring member lying in a plane normal to the median plane of the spark plug which contains the ground electrode, said ring member spaced from and spanning the ground electrode.

2. A spark plug as recited in claim 1, wherein the said ring member has a fluted surface portion.

3. A spark plug as recited in claim 1, wherein the said ring member has an elliptical cross-sectional configuration.

4. A spark plug as recited in claim 1, wherein the said ring member is made of ceramic.

5. A spark plug as recited in claim 1, wherein the said ring member has a semi-circular shape.

6. A spark plug as recited in claim 1, wherein the said core is a ceramic and covers the end of the center electrode proximate to the ground electrode.

7. A spark plug as recited in claim 6, wherein the center electrode is disposed in a bore formed in the core and has an enlarged head proximate to the ground electrode.

8. A spark plug as recited in claim 6, wherein the center electrode is disposed in a bore formed in the core and extends into graphite powder contained in the bottom of the core.

9. A spark plug as recited in claim 1, wherein said shell has a circular groove formed in the end surface thereof and an internally threaded portion, and including a cylindrical insert member having a shank threaded into said groove, said shank terminating in a flange having a slot, and wherein said ground electrode extends through the said slot and includes an end portion positioned in said circular groove.

10. A spark plug as recited in claim 9, including means forming a pair of holes in the said flange, wherein said ring member has a semi-circular shape, and wherein said ring member has reduced-diameter end portions inserted into the said holes.

11. A spark plug as recited in claim 10, wherein the said ring member has an elliptical cross-sectional configuration.

12. A spark plug as recited in claim 6, wherein the center electrode is a metal paste.

* * * * *